US008726647B2

(12) United States Patent
Peterson et al.

(10) Patent No.: US 8,726,647 B2
(45) Date of Patent: May 20, 2014

(54) HYDRAULIC CONTROL SYSTEM HAVING CYLINDER STALL STRATEGY

(75) Inventors: Grant S. Peterson, Metamora, IL (US); Randall T. Anderson, Peoria, IL (US); Rustu Cesur, Lombard, IL (US); Jason L. Brinkman, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 706 days.

(21) Appl. No.: 13/036,421

(22) Filed: Feb. 28, 2011

(65) Prior Publication Data

US 2012/0216517 A1 Aug. 30, 2012

(51) Int. Cl.
*F15B 21/08* (2006.01)

(52) U.S. Cl.
USPC ..... 60/422; 701/50

(58) Field of Classification Search
CPC ..... F15B 11/16; F15B 11/161; F15B 21/087; F15B 2211/6313; F15B 2211/6336; E02F 9/2296
USPC ..... 60/422, 430, 459; 91/435, 436; 701/50
See application file for complete search history.

(56) References Cited

U.S. PATENT DOCUMENTS

| | | | | |
|---|---|---|---|---|
| 5,832,805 | A | 11/1998 | Kurashima et al. | |
| 6,321,152 | B1 | 11/2001 | Amborski et al. | |
| 6,775,974 | B2 | 8/2004 | Tabor | |
| 6,912,849 | B2 | 7/2005 | Inoue et al. | |
| 7,260,931 | B2 * | 8/2007 | Egelja et al. | 60/422 |
| 7,614,336 | B2 * | 11/2009 | VerKuilen et al. | 91/446 |
| 7,665,299 | B2 | 2/2010 | Schuh et al. | |
| 7,712,309 | B2 | 5/2010 | Vigholm | |

(Continued)

FOREIGN PATENT DOCUMENTS

| | | |
|---|---|---|
| EP | 1300595 | 4/2003 |
| EP | 1338832 | 8/2003 |
| JP | 07174105 | 7/1995 |
| KR | 1020100072482 | 7/2010 |

OTHER PUBLICATIONS

Phanindra Garimella et al., "Fault Detection of an Electro-Hydraulic Cylinder Using Adaptive Robus Observers," IMECE2004-61718, 2004 ASME International Mechanical Engineering Congress and Exposition, Nov. 13-20, 2004.

(Continued)

*Primary Examiner* — Thomas E Lazo
(74) *Attorney, Agent, or Firm* — Finnegan, Henderson, Farabow, Garrett & Dunner LLP

(57) ABSTRACT

A hydraulic control system for a machine is disclosed. The hydraulic control system may have a hydraulic circuit, a pump configured to supply pressurized fluid, and a first sensor configured to generate a first signal indicative of a pressure of the hydraulic circuit. The hydraulic circuit may also have a first fluid actuator fluidly connected to receive pressurized fluid from the hydraulic circuit, a second sensor configured to generate a second signal indicative of a velocity of the first fluid actuator, and a controller in communication with the first and second sensors. The controller may be configured to receive an input indicative of a desired flow rate for the first fluid actuator, to determine an actual flow rate of the first fluid actuator based on the second signal, and to determine a stall condition of the first fluid actuator based on the desired flow rate, the actual flow rate, and the first signal.

20 Claims, 3 Drawing Sheets

(56) References Cited

U.S. PATENT DOCUMENTS

| | | | | |
|---|---|---|---|---|
| 7,853,382 | B2 * | 12/2010 | Anderson | 701/50 |
| 7,979,181 | B2 * | 7/2011 | Clark et al. | 701/50 |
| 8,340,875 | B1 * | 12/2012 | Shatters et al. | 701/50 |
| 2002/0108486 | A1 | 8/2002 | Sannomiya et al. | |
| 2003/0158646 | A1 | 8/2003 | Nishida et al. | |
| 2007/0074510 | A1 | 4/2007 | Verkuilen et al. | |
| 2010/0229705 | A1 | 9/2010 | Christoforou et al. | |

OTHER PUBLICATIONS

U.S. Patent Application of Grant S. Peterson et al. entitled "Hydraulic Control System Having Cylinder Flow Correction" filed Feb. 28, 2011.

U.S. Patent Application of Grant S. Peterson et al. entitled "Hydraulic Control System Implementing Pump Torque Limiting" filed Feb. 28, 2011.

U.S. Patent Application of Grant S. Peterson et al. entitled "Hydraulic Control System Having Cylinder Stall Strategy" filed Feb. 28, 2011.

* cited by examiner

HYDRAULIC CONTROL SYSTEM HAVING CYLINDER STALL STRATEGY

TECHNICAL FIELD

The present disclosure relates generally to a hydraulic control system, and more particularly, to a hydraulic control system that has a cylinder stall detection and control strategy.

BACKGROUND

Machines such as wheel loaders, excavators, dozers, motor graders, and other types of heavy equipment use multiple actuators supplied with hydraulic fluid from one or more pumps on the machine to accomplish a variety of tasks. These actuators are typically velocity controlled based on an actuation position of an operator interface device. However, when the movement of one of the actuators is restricted by an external load, the restricted actuator can slow dramatically or even stop moving altogether even though the operator interface device is still displaced toward an actuated position (i.e., the restricted actuator can stall). If pressurized fluid continues to be allocated to the stalled cylinder based on the displacement position of the operator interface device, efficiency of the machine can be reduced. In addition, fluid pressure of the entire system can rise abruptly when any one of the machine's actuators has its movement restricted. In some situations, the rise in pressure can be high enough to cause the pump to stall and/or reduce controllability of other connected actuators. Further, because the pressure of the fluid supplied to all of the actuators is generally controlled by the single highest pressure of any one actuator in the system, during a single-actuator stall condition when system pressures rise, the flow rate of fluid supplied to all of the actuators could be needlessly reduced resulting in a general loss of production and controllability.

One method of improving machine operations during a stall condition is described in U.S. Pat. No. 7,260,931 (the '931 patent) issued to Egelja et al. on Aug. 28, 2007. Specifically, the '931 patent describes a hydraulic system for use in an excavation machine. The hydraulic system includes a first circuit supplied with pressurized fluid from a first pump and having, among other actuators, a boom cylinder. The hydraulic system also includes a second circuit supplied with pressurized fluid from a second pump and having, among other actuators, a swing motor. During a swinging movement of the excavation machine, when linkage of the machine contacts an obstacle and the swing motor is restricted from moving, fluid pressure supplied to all actuators of the second circuit rapidly increases. In response to the rapidly increasing pressure, the second pump quickly destrokes in an attempt to reduce the pressures in the second circuit and avoid stall conditions. In order to enhance controllability over movement of other actuators within the second circuit during the reducing pump output, the flow rates commanded of the second circuit actuators are scaled down according to a ratio of sensed pressure-to-stall pressure of the second pump. At this same time, any flow from the second circuit that exceeds the scaled down flow rate is diverted into the first circuit and made available to boost movement of the boom cylinder.

Although the system of the '931 patent may help to improve some machine operations during a stall condition, the system may lack applicability. In particular, the system may lack applicability to a machine having only a single circuit with a single pump, and/or to conditions associated with stall of only a subset of actuators within a single circuit.

The disclosed hydraulic control system is directed to overcoming one or more of the problems set forth above and/or other problems of the prior art.

SUMMARY

In one aspect, the present disclosure is directed to a hydraulic control system. The hydraulic control system may include a hydraulic circuit, a pump configured to supply pressurized fluid to the hydraulic circuit, and a first sensor associated with the hydraulic circuit and configured to generate a first signal indicative of a pressure of the hydraulic circuit. The hydraulic circuit may also include a first fluid actuator connected to receive pressurized fluid from the hydraulic circuit, a second sensor associated with the first fluid actuator and configured to generate a second signal indicative of a velocity of the first fluid actuator, and a controller in communication with the first and second sensors. The controller may be configured to receive an input indicative of a desired flow rate for the first fluid actuator, to determine an actual flow rate of the first fluid actuator based on the second signal, and to determine a stall condition of the first fluid actuator based on the desired flow rate, the actual flow rate, and the first signal.

In another aspect, the present disclosure is directed to a method of operating a machine. The method may include pressurizing a fluid, sensing a pressure of the fluid, and directing a first flow of the pressurized fluid to move the machine in a first manner. The method may also include sensing an actual velocity of machine movement in the first manner, receiving an input indicative of a desired rate of the first flow, and determining an actual rate of the first flow based on the actual velocity. The method may additionally include determining a stall condition associated with machine movement in the first manner based on the desired rate, the actual rate, and the pressure.

DETAILED DESCRIPTION

Figure 1:
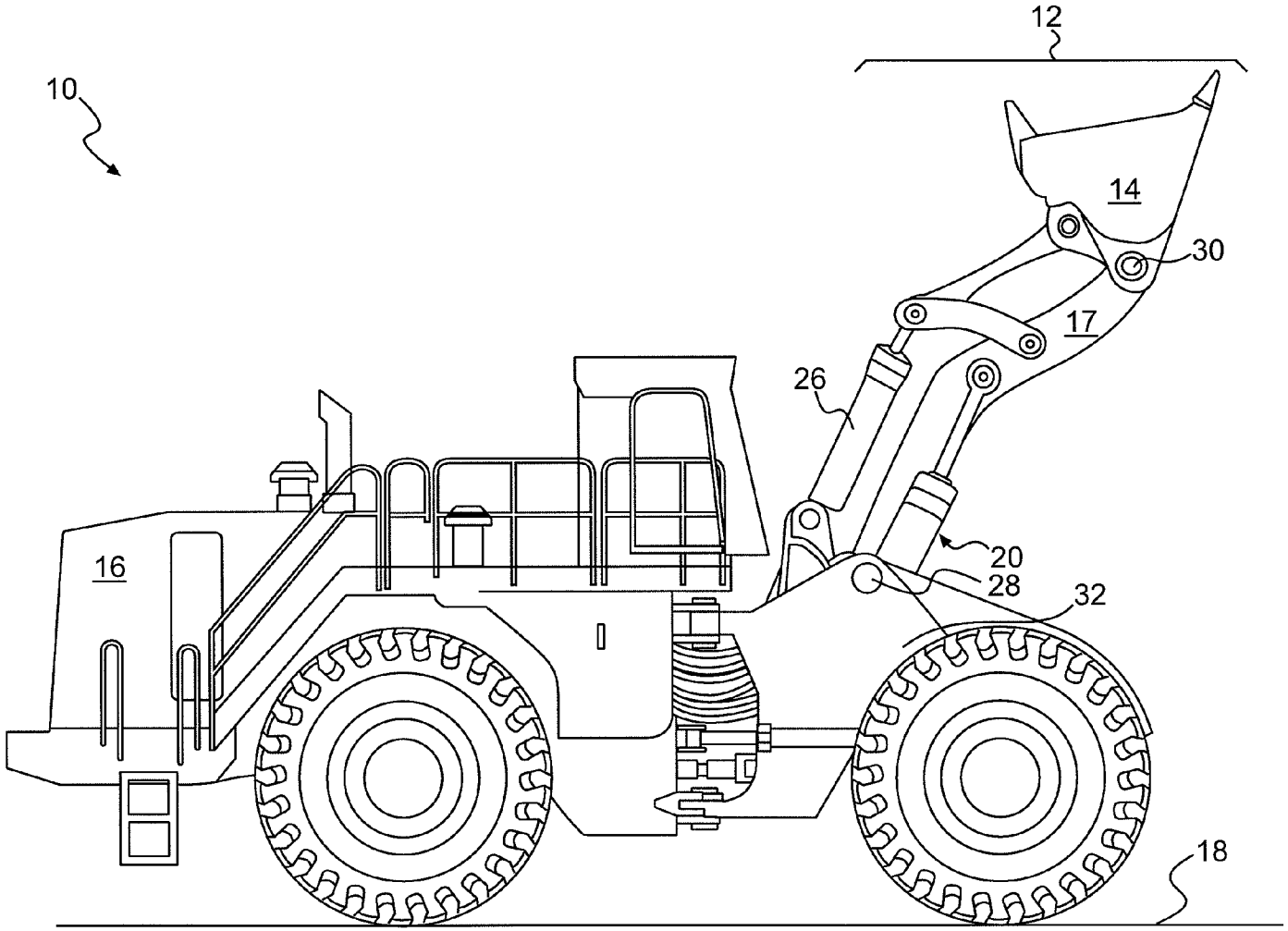
FIG. 1 is a side-view diagrammatic illustration of an exemplary disclosed machine.

FIG. 1 illustrates an exemplary machine 10 having multiple systems and components that cooperate to accomplish a task. Machine 10 may embody a fixed or mobile machine that performs some type of operation associated with an industry such as mining, construction, farming, transportation, or another industry known in the art. For example, machine 10 may be a material moving machine such as the loader depicted in FIG. 1. Alternatively, machine 10 could embody an excavator, a dozer, a backhoe, a motor grader, a dump truck, or another earth moving machine. Machine 10 may include a linkage system 12 configured to move a work tool 14, and a prime mover 16 that provides power to linkage system 12.

Linkage system 12 may include structure acted on by fluid actuators to move work tool 14. Specifically, linkage system 12 may include a boom (i.e., a lifting member) 17 that is vertically pivotable about a horizontal axis 28 relative to a work surface 18 by a pair of adjacent, double-acting, hydraulic cylinders 20 (only one shown in FIG. 1). Linkage system 12 may also include a single, double-acting, hydraulic cylinder 26 connected to tilt work tool 14 relative to boom 17 in a vertical direction about a horizontal axis 30. Boom 17 may be pivotably connected at one end to a body 32 of machine 10, while work tool 14 may be pivotably connected to an opposing end of boom 17.

Numerous different work tools 14 may be attachable to a single machine 10 and controlled to perform a particular task. For example, work tool 14 could embody a bucket, a fork arrangement, a blade, a shovel, a ripper, a dump bed, a broom, a snow blower, a propelling device, a cutting device, a grasping device, or another task-performing device known in the art. Although connected in the embodiment of FIG. 1 to lift and tilt relative to machine 10, work tool 14 may alternatively or additionally pivot, rotate, slide, swing, or move in any other manner known in the art.

Prime mover 16 may embody an engine such as, for example, a diesel engine, a gasoline engine, a gaseous fuel-powered engine, or any other type of combustion engine known in the art that is supported by body 32 of machine 10 and operable to power the movements of machine 10 and work tool 14. It is contemplated that prime mover may alternatively embody a non-combustion source of power such as a fuel cell, a power storage device, or another source known in the art. Prime mover may produce a mechanical or electrical power output that may then be converted to hydraulic power for moving hydraulic cylinders 20 and 26.

Figure 2:
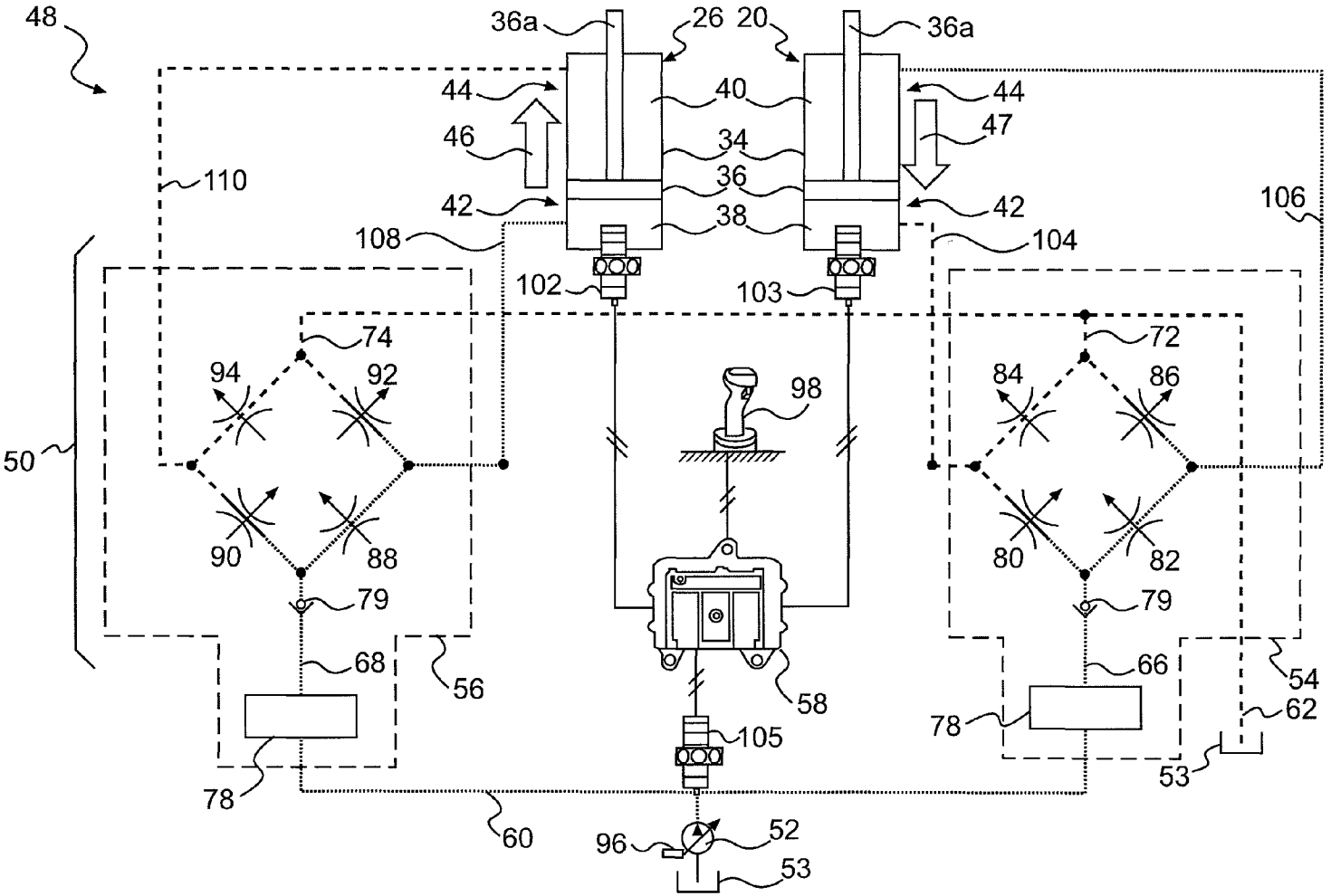
FIG. 2 is a schematic illustration of an exemplary disclosed hydraulic control system that may be used in conjunction with the machine of FIG. 1.

For purposes of simplicity, FIG. 2 illustrates the composition and connections of only hydraulic cylinder 26 and one of hydraulic cylinders 20. It should be noted, however, that machine 10 may include other hydraulic actuators of similar composition connected to move the same or other structural members of linkage system 12 in a similar manner, if desired.

As shown in FIG. 2, each of hydraulic cylinders 20 and 26 may include a tube 34 and a piston assembly 36 arranged within tube 34 to form a first pressure chamber 38 and a second pressure chamber 40. In one example, a rod portion 36*a* of piston assembly 36 may extend through second pressure chamber 40. As such, second pressure chamber 40 may be associated with a rod-end 44 of its respective cylinder, while first pressure chamber 38 may be associated with an opposing head-end 42 of its respective cylinder.

First and second pressure chambers 38, 40 may each be selectively supplied with pressurized fluid and drained of the pressurized fluid to cause piston assembly 36 to displace within tube 34, thereby changing an effective length of hydraulic cylinders 20, 26 and moving work tool 14 (referring to FIG. 1). A flow rate of fluid into and out of first and second pressure chambers 38, 40 may relate to a velocity of hydraulic cylinders 20, 26 and work took 14, while a pressure differential between first and second pressure chambers 38, 40 may relate to a force imparted by hydraulic cylinders 20, 26 on work tool 14. An expansion (represented by an arrow 46) and a retraction (represented by an arrow 47) of hydraulic cylinders 20, 26 may function to assist in moving work tool 14 in different manners (e.g., lifting and tilting work tool 14, respectively).

To help regulate filling and draining of first and second chambers 38, 40, machine 10 may include a hydraulic control system 48 having a plurality of interconnecting and cooperating fluid components. In particular, hydraulic control system 48 may include valve stack 50 at least partially forming a circuit between hydraulic cylinders 20, 26, an engine-driven pump 52 and tank 53. Valve stack 50 may include a lift valve arrangement 54, a tilt valve arrangement 56, and, in some embodiments, one or more auxiliary valve arrangements (not shown) fluidly connected to receive and discharge pressurized fluid in parallel fashion. In one example, valve arrangements 54, 56 may include separate bodies bolted to each other to form valve stack 50. In another embodiment, each of valve arrangements 54, 56 may be stand-alone arrangements, connected only by way of external fluid conduits (not shown). It is contemplated that a greater number, a lesser number, or a different configuration of valve arrangements may be included within valve stack 50, if desired. For example, a swing valve arrangement (not shown) configured to control a swinging motion of linkage system 12, one or more travel valve arrangements, and other suitable valve arrangements may be included in valve stack 50. Hydraulic control system 48 may further include a controller 58 in communication with valve arrangements 54, 56 to control corresponding movements of hydraulic cylinders 20, 26.

Each of lift and tilt valve arrangements 54, 56 may regulate the motion of their associated fluid actuators. Specifically, lift valve arrangement 54 may have elements movable to control the motions of both of hydraulic cylinders 20 and lift boom 17 relative to work surface 18. Likewise, tilt valve arrangement 56 may have elements movable to control the motion of hydraulic cylinder 26 and tilt work tool 14 relative to boom 17.

Valve arrangements 54, 56 may be connected to regulate flows of pressurized fluid to and from hydraulic cylinders 20, 26 via common passages. Specifically, valve arrangements 54, 56 may be connected to pump 52 by way of a common supply passage 60, and to tank 53 by way of a common drain passage 62. Lift and tilt valve arrangements 54, 56 may be connected in parallel to common supply passage 60 by way of individual fluid passages 66 and 68 respectively, and in parallel to common drain passage 62 by way of individual fluid passages 72 and 74, respectively. A pressure compensating valve 78 and/or a check valve 79 may be disposed within each of fluid passages 66, 68 to provide a unidirectional supply of fluid having a substantially constant flow to valve arrangements 54, 56. Pressure compensating valves 78 may be pre- (shown in FIG. 2) or post-compensating valves movable in response to a differential pressure between a flow passing position and a flow blocking position, such that a substantially constant flow of fluid is provided to valve arrangements 54 and 56, even when a pressure of the fluid directed to pressure compensating valves 78 varies. It is contemplated that, in some applications, pressure compensating valves 78 and/or check valves 79 may be omitted, if desired.

Each of lift and tilt valve arrangements 54, 56 may be substantially identical and include four independent metering valves (IMVs). Of the four IMVs, two may be generally associated with fluid supply functions, while two may be generally associated with drain functions. For example, lift valve arrangement 54 may include a head-end supply valve 80, a rod-end supply valve 82, a head-end drain valve 84, and a rod-end drain valve 86. Similarly, tilt valve arrangement 56 may include a head-end supply valve 88, a rod-end supply valve 90, a head-end drain valve 92, and a rod-end drain valve 94.

Head-end supply valve 80 may be disposed between fluid passage 66 and a fluid passage 104 that leads to first chamber 38 of hydraulic cylinder 20, and be configured to regulate a flow rate of pressurized fluid to first chamber 38 in response to a flow command from controller 58. Head-end supply valve 80 may include a variable-position, spring-biased valve element, for example a poppet or spool element, that is solenoid actuated and configured to move to any position between a first end-position at which fluid is allowed to flow into first chamber 38, and a second end-position at which fluid flow is blocked from first chamber 38. It is contemplated that head-end supply valve 80 may include additional or different elements such as, for example, a fixed-position valve element or any other valve element known in the art. It is also contemplated that head-end supply valve 80 may alternatively be hydraulically actuated, mechanically actuated, pneumatically actuated, or actuated in any other suitable manner.

Rod-end supply valve 82 may be disposed between fluid passage 66 and a fluid passage 106 leading to second chamber 40 of hydraulic cylinder 20, and be configured to regulate a flow rate of pressurized fluid to second chamber 40 in response to a flow command from controller 58. Rod-end supply valve 82 may include a variable-position, spring-biased valve element, for example a poppet or spool element, that is solenoid actuated and configured to move to any position between a first end-position at which fluid is allowed to flow into second chamber 40, and a second end-position at which fluid is blocked from second chamber 40. It is contemplated that rod-end supply valve 82 may include additional or different valve elements such as, for example, a fixed-position valve element or any other valve element known in the art. It is also contemplated that rod-end supply valve 82 may alternatively be hydraulically actuated, mechanically actuated, pneumatically actuated, or actuated in any other suitable manner.

Head-end drain valve 84 may be disposed between fluid passage 104 and fluid passage 72, and be configured to regulate a flow rate of pressurized fluid from first chamber 38 of hydraulic cylinder 20 to tank 53 in response to a flow command from controller 58. Head-end drain valve 84 may include a variable-position, spring-biased valve element, for example a poppet or spool element, that is solenoid actuated and configured to move to any position between a first end-position at which fluid is allowed to flow from first chamber 38, and a second end-position at which fluid is blocked from flowing from first chamber 38. It is contemplated that head-end drain valve 84 may include additional or different valve elements such as, for example, a fixed-position valve element or any other valve element known in the art. It is also contemplated that head-end drain valve 84 may alternatively be hydraulically actuated, mechanically actuated, pneumatically actuated, or actuated in any other suitable manner.

Rod-end drain valve 86 may be disposed between fluid passage 106 and fluid passage 72, and be configured to regulate a flow rate of pressurized fluid from second chamber 40 of hydraulic cylinder 20 to tank 53 in response to a flow command from controller 58. Rod-end drain valve 86 may include a variable-position, spring-biased valve element, for example a poppet or spool element, that is solenoid actuated and configured to move to any position between a first end-position at which fluid is allowed to flow from second chamber 40, and a second end-position at which fluid is blocked from flowing from second chamber 40. It is contemplated that rod-end drain valve 86 may include additional or different valve elements such as, for example, a fixed-position valve element or any other valve element known in the art. It is also contemplated that rod-end drain valve 86 may alternatively be hydraulically actuated, mechanically actuated, pneumatically actuated, or actuated in any other suitable manner.

Head-end supply valve 88 may be disposed between fluid passage 68 and a fluid passage 108 that leads to first chamber 38 of hydraulic cylinder 26, and be configured to regulate a flow rate of pressurized fluid to first chamber 38 in response to a flow command from controller 58. Head-end supply valve 88 may include a variable-position, spring-biased valve element, for example a poppet or spool element, that is solenoid actuated and configured to move to any position between a first end-position at which fluid is allowed to flow into first chamber 38, and a second end-position at which fluid flow is blocked from first chamber 38. It is contemplated that head-end supply valve 88 may include additional or different elements such as, for example, a fixed-position valve element or any other valve element known in the art. It is also contemplated that head-end supply valve 88 may alternatively be hydraulically actuated, mechanically actuated, pneumatically actuated, or actuated in any other suitable manner.

Rod-end supply valve 90 may be disposed between fluid passage 68 and a fluid passage 110 that leads to second chamber 40 of hydraulic cylinder 26, and be configured to regulate a flow rate of pressurized fluid to second chamber 40 in response to a flow command from controller 58. Specifically, rod-end supply valve 90 may include a variable-position, spring-biased valve element, for example a poppet or spool element, that is solenoid actuated and configured to move to any position between a first end-position, at which fluid is allowed to flow into second chamber 40, and a second end-position, at which fluid is blocked from second chamber 40. It is contemplated that rod-end supply valve 90 may include additional or different valve elements such as, for example, a fixed-position valve element or any other valve element known in the art. It is also contemplated that rod-end supply valve 90 may alternatively be hydraulically actuated, mechanically actuated, pneumatically actuated, or actuated in any other suitable manner.

Head-end drain valve 92 may be disposed between fluid passage 108 and fluid passage 74, and be configured to regulate a flow rate of pressurized fluid from first chamber 38 of hydraulic cylinder 26 to tank 53 in response to a flow command from controller 58. Specifically, head-end drain valve 92 may include a variable-position, spring-biased valve element, for example a poppet or spool element, that is solenoid actuated and configured to move to any position between a first end-position at which fluid is allowed to flow from first chamber 38, and a second end-position at which fluid is blocked from flowing from first chamber 38. It is contemplated that head-end drain valve 92 may include additional or different valve elements such as, for example, a fixed-position valve element or any other valve element known in the art. It is also contemplated that head-end drain valve 92 may alternatively be hydraulically actuated, mechanically actuated, pneumatically actuated, or actuated in any other suitable manner.

Rod-end drain valve 94 may be disposed between fluid passage 110 and fluid passage 74, and be configured to regulate a flow rate of pressurized fluid from second chamber 40 of hydraulic cylinder 26 to tank 53 in response to a flow command from controller 58. Rod-end drain valve 94 may include a variable-position, spring-biased valve element, for example a poppet or spool element, that is solenoid actuated and configured to move to any position between a first end-position at which fluid is allowed to flow from second chamber 40, and a second end-position at which fluid is blocked from flowing from second chamber 40. It is contemplated that rod-end drain valve 94 may include additional or different valve element such as, for example, a fixed-position valve element or any other valve elements known in the art. It is also contemplated that rod-end drain valve 94 may alternatively be hydraulically actuated, mechanically actuated, pneumatically actuated, or actuated in any other suitable manner.

Pump 52 may have variable displacement and be load-sense controlled to draw fluid from tank 53 and discharge the fluid at an elevated pressure to valve arrangements 54, 56. That is, pump 52 may include a stroke-adjusting mechanism 96, for example a swashplate or spill valve, a position of which is hydro-mechanically adjusted based on a sensed load of hydraulic control system 48 to thereby vary an output (i.e., a discharge rate) of pump 52. The displacement of pump 52 may be adjusted from a zero displacement position at which substantially no fluid is discharged from pump 52, to a maximum displacement position at which fluid is discharged from pump 52 at a maximum rate. In one embodiment, a load-sense passage (not shown) may direct a pressure signal to stroke-adjusting mechanism 96 and, based on a value of that signal (i.e., based on a pressure of signal fluid), the position of stroke-adjusting mechanism 96 may change to either increase or decrease the output of pump 52. Pump 52 may be drivably connected to prime mover 16 of machine 10 by, for example, a countershaft, a belt, or in any other suitable manner. Alternatively, pump 52 may be indirectly connected to prime mover 16 via a torque converter, a gear box, an electrical circuit, or in any other manner known in the art.

Tank 53 may constitute a reservoir configured to hold a supply of fluid. The fluid may include, for example, a dedicated hydraulic oil, an engine lubrication oil, a transmission lubrication oil, or any other fluid known in the art. One or more hydraulic circuits within machine 10 may draw fluid from and return fluid to tank 53. It is also contemplated that hydraulic control system 48 may be connected to multiple separate fluid tanks, if desired.

Controller 58 may embody a single microprocessor or multiple microprocessors that include components for controlling valve arrangements 54, 56 based on input from an operator of machine 10 and based on sensed operational parameters. Numerous commercially available microprocessors can be configured to perform the functions of controller 58. It should be appreciated that controller 58 could readily be embodied in a general machine microprocessor capable of controlling numerous machine functions. Controller 58 may include a memory, a secondary storage device, a processor, and any other components for running an application. Various other circuits may be associated with controller 58 such as power supply circuitry, signal conditioning circuitry, solenoid driver circuitry, and other types of circuitry.

Controller 58 may receive operator input associated with a desired movement of machine 10 by way of one or more interface devices 98 that are located within an operator station of machine 10. Interface devices 98 may embody, for example, single or multi-axis joysticks, levers, or other known interface devices located proximate an operator seat (if directly controlled by an onboard operator). Each interface device 98 may be a proportional-type device that is movable through a range from a neutral position to a maximum displaced position to generate a corresponding displacement signal that is indicative of a desired velocity of work tool 14 caused by hydraulic cylinders 20, 26, for example a desired tilting and lifting velocity of work tool 14. These signal(s) may be generated independently or simultaneously by the same or different interface devices 98, and be directed to controller 58 for further processing.

One or more maps relating the interface device position signal(s), the corresponding desired work tool velocity, associated flow rates, valve element positions, system pressure, and/or other characteristics of hydraulic control system 48 may be stored in the memory of controller 58. Each of these maps may be in the form of tables, graphs, and/or equations. In one example, desired work tool velocity, system pressure, and/or commanded flow rates may form the coordinate axis of a 2- or 3-D table for control of head- and rod-end supply valves 80, 82, 88, 90. The commanded flow rates required to move hydraulic cylinders 20, 26 at the desired velocities and corresponding valve element positions of the appropriate valve arrangements 54, 56 may be related in the same or another separate 2- or 3-D map, as desired. It is also contemplated that desired velocity may be directly related to the valve element position in a single 2-D map. Controller 58 may be configured to allow the operator to directly modify these maps and/or to select specific maps from available relationship maps stored in the memory of controller 58 to affect actuation of hydraulic cylinders 20, 26. It is also contemplated that the maps may be automatically selected for use by controller 58 based on sensed or determined modes of machine operation, if desired.

Controller 58 may be configured to receive input from interface device 98 and to command operation of valve arrangements 54, 56 in response to the input and based on the relationship maps described above. Specifically, controller 58 may receive the interface device position signal indicative of a desired velocity, and reference the selected and/or modified relationship maps stored in the memory of controller 58 to determine desired flow rate values and/or associated positions for each of the supply and drain elements within valve arrangements 54, 56. The desired flow rates and/or positions may then be commanded of the appropriate supply and drain elements to cause filling of first or second chambers 38, 40 of hydraulic cylinders 20, 26 at rates that result in the desired work tool velocities.

Controller 58 may also be configured to determine a stall condition of hydraulic cylinders 20, 26 during machine operation based on sensed parameters of hydraulic control system 48. For example based on sensed velocities of hydraulic cylinders 20, 26, the desired velocities of hydraulic cylinders 20, 26 (i.e., the desired lifting and tilting velocities of work tool 14, as received from interface device 98), known geometry of hydraulic cylinders 20, 26 (e.g., flow and/or pressure areas within hydraulic cylinders 20, 26), and the pressure of fluid supplied to hydraulic cylinders 20, 26 by pump 52, controller 58 may be configured to determine which, if any, of hydraulic cylinders 20, 26 are stalled. For the purposes of this disclosure, cylinder stall may be defined as the condition during which a cylinder (e.g., one of hydraulic cylinders 20, 26) has been supplied with pressurized fluid normally sufficient to move the cylinder and a loaded work tool, but little or no movement is achieved. This condition may be present, for example, when work tool 14 has been moved by cylinders 20 and/or 26 against an obstacle of significant mass, which resists further tool movement with a force greater than the force applied by cylinders 20 and/or 26 (i.e., when the load of the obstacle exceeds the breakout force). Cylinder stall determination will be described in detail in the following section.

The actual velocities of hydraulic cylinders 20, 26 may be sensed by one or more velocity sensors 102, 103, while the pressure of hydraulic control system 48 may be sensed by a pressure sensor 105. Velocity sensors 102, 103 may each embody magnetic pickup type sensors associated with magnets (not shown) embedded within piston assemblies 36 of hydraulic cylinders 20 and 26 that are configured to detect extension positions of hydraulic cylinders 20, 26, index position changes to time, and generate corresponding signals indicative of the velocities of hydraulic cylinders 20, 26. As hydraulic cylinders 20, 26 extend and retract, velocity sensors 102, 103 may generate and direct the signals to controller 58. It is contemplated that velocity sensors 102, 103 may alternatively embody other types of sensors such as, for example, magnetostrictive-type sensors associated with a wave guide (not shown) internal to hydraulic cylinders 20, 26, cable type sensors associated with cables (not shown) externally mounted to hydraulic cylinders 20, 26, internally- or externally-mounted optical sensors, rotary style sensors associated with a joint pivotable by hydraulic cylinders 20, 26, or any other type of velocity sensors known in the art. It is further contemplated that velocity sensors 102, 103 may alternatively only be configured to generate signals associated with the extension and retraction positions of hydraulic cylinders 20, 26. In this situation, controller 58 may index the position signals according to time, thereby determining the velocities of hydraulic cylinders 20, 26 based on the signals from velocity sensors 102, 103.

Pressure sensor 105 may embody any type of sensor configured to generate a signal indicative of a pressure of hydraulic control system 48. For example, pressure sensor 105 may be a strain gauge-type, capacitance-type, or piezo-type compression sensor configured to generate a signal proportional to a compression of an associated sensor element by fluid in communication with the sensor element. Signals generated by pressure sensor 105 may be directed to controller 58 for further processing.

Controller 58 may be further configured to implement a control strategy during a determined stall condition of hydraulic cylinders 20, 26 that improves machine controllability, productivity, and efficiency. In particular, during stall conditions of one of hydraulic cylinders 20, 26, controller 58 may be configured to implement a flow-sharing control strategy that selectively redirects fluid from the stalled cylinder away to other cylinders of hydraulic control system 48 that are not experiencing the stall condition. This strategy will be discussed in more detail in the following section.

Figure 3:
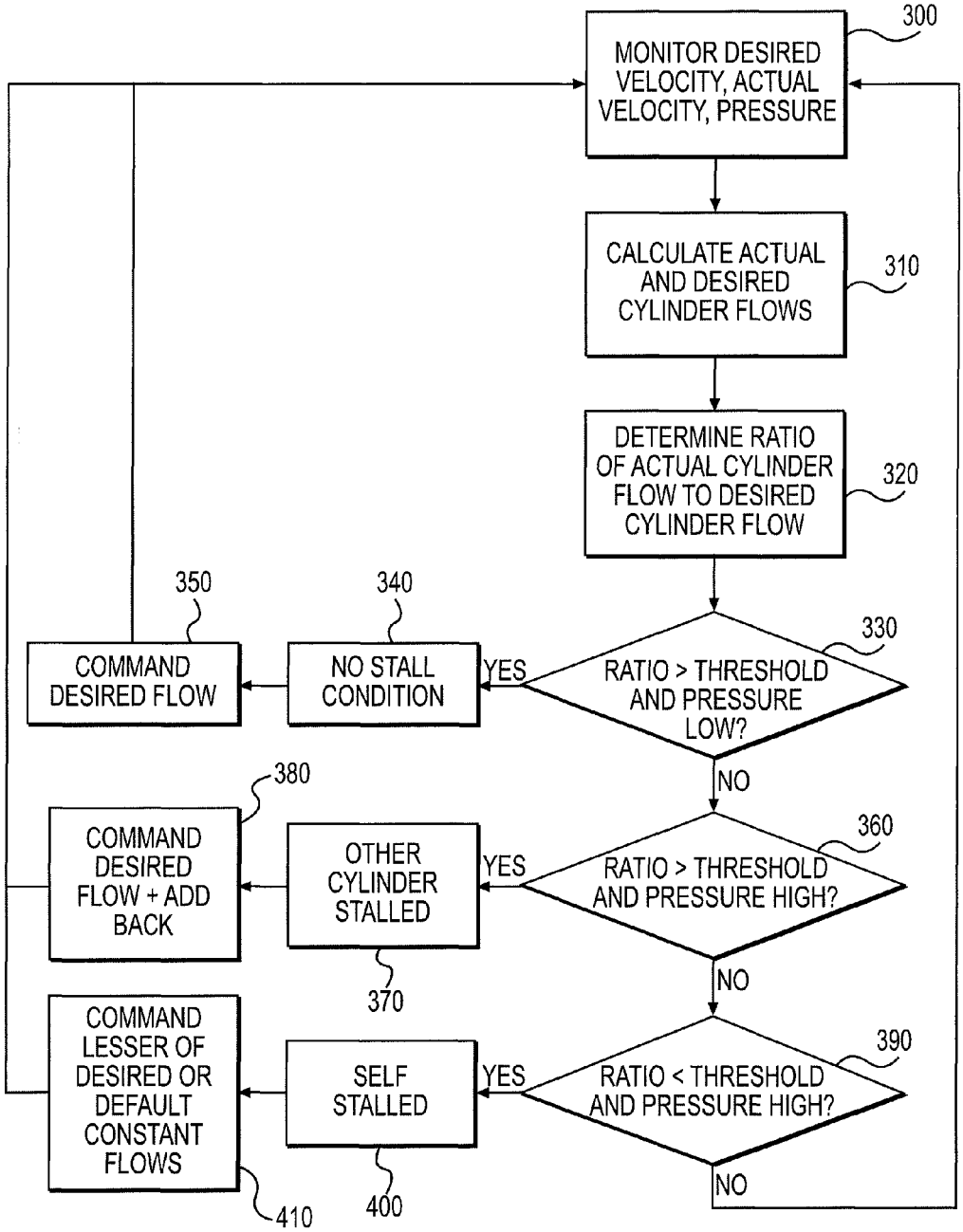
FIG. 3 is a flow chart illustrating an exemplary disclosed method performed by the hydraulic control system of FIG. 2.

FIG. 3 illustrates exemplary operations performed by hydraulic control system 48. FIG. 3 will be discussed in more detail in the following section to further illustrate the disclosed concepts.

INDUSTRIAL APPLICABILITY

The disclosed hydraulic control system may be applicable to any machine that includes multiple fluid actuators where controllability, productivity, and efficiency are issues. The disclosed hydraulic control system may enhance controllability, productivity, and efficiency by detecting when an actuator of the system has stalled, and selectively implementing a flow-sharing strategy based on the stalled condition. Operation of hydraulic control system 48 will now be explained.

During operation of machine 10, a machine operator may manipulate interface device 98 to cause a corresponding movement of work tool 14. The displacement position of interface device 98 may be related to an operator desired velocity of work tool 14. Operator interface device 98 may generate a position signal indicative of the operator desired velocity during manipulation and direct this position signal to controller 58 for further processing.

Controller 58 may receive input during operation of hydraulic cylinders 20, 26, and make determinations based on the input. Specifically, controller 58 may receive, among other things, the operator interface device position signal and reference the maps stored in memory to determine desired velocities for each fluid actuator within hydraulic control system 48 and the corresponding desired flow rates. These corresponding desired flow rates may then be commanded of the appropriate supply and drain elements of actuator valve arrangements 54, 56 to move hydraulic cylinders 20, 26 in a manner that results in the desired velocities of work tool 14.

At some points in the operation of machine 10, situations may arise where the movement of a member of linkage system 12 is restricted. For example, as work tool 14 is driven into a pile of earthen material, bucket forces acting through linkage system 12 on hydraulic cylinders 20, 26 may increase. In some instances, the reactive forces exerted by the pile could exceed the breakout force of hydraulic cylinders 20 or 26, thereby causing one or more of hydraulic cylinders 20, 26 to stall and stop moving in the manner desired by the operator. If left unchecked, operation of machine 10 may degrade during the stall condition, leaving the operator with a reduced ability to modulate movements of work tool 14 and with low machine productivity and efficiency.

To help reduce the negative consequences associated with cylinder stall described above, controller 58 may be configured to determine which of hydraulic cylinders 20, 26 is experiencing the stall condition, and to selectively initiate flow-sharing between hydraulic cylinders 20, 26 based on the determination. As shown in FIG. 3, the first step in the flow sharing strategy may include the monitoring of desired velocities of hydraulic cylinders 20, 26, sensing the actual velocities of hydraulic cylinders 20, 26, and sensing the pressure of hydraulic control system 48 (Step 300). As described above, the desired velocities of hydraulic cylinders 20, 26 can be received from the operator of machine 10 by way of interface device(s) 98. The actual velocities of hydraulic cylinders 20, 26 may either be directly sensed via velocity sensors 102, 103 or, alternatively, the positions of hydraulic cylinders 20, 26 may be directly sensed by velocity sensors 102, 103 and subsequently indexed according to time by controller 58 to determine the actual velocities. The pressure of hydraulic control system 48 may be sensed by pressure sensor 105. Signals indicative of the desired velocities, actual velocities, and pressure may be directed to controller 58 for further processing.

After receiving the signals from interface device(s) 98, velocities sensors 102, 103, and pressure sensor 105, controller 58 may be configured to calculate actual fluid flow rates of each cylinder 20, 26 and desired fluid flow rates (Step 310). The actual fluid flow rate for each of hydraulic cylinders 20, 26 may be calculated as a function of the measured or determined velocity of each cylinder 20, 26 and a corresponding known cross-sectional flow area within each cylinder 20, 26. The desired fluid flow rates may correspond with flow rate commands directed to the respective valve arrangements, which were previously determined by referencing the desired cylinder velocity, actual pressure of hydraulic control system 48, and valve opening positions of the supply valves with the relationship maps stored in memory. Controller 58 may then determine a ratio of the actual fluid flow rate to the desired fluid flow rate for each of hydraulic cylinders 20, 26 (Step 320).

Controller 58 may compare the calculated ratio and system pressure to a first ratio threshold and a pressure threshold, respectively, to determine if individual ones of hydraulic cylinders 20, 26 are experiencing the stalled condition. In one example, the first ratio threshold may be in the range of about 0-0.2, while the pressure threshold may be a pressure about equal to 90% of a maximum system pressure. When the calculated ratio is less than about 0.2, it can be determined that the actual flow rate of a particular one of hydraulic cylinders 20, 26 is far less than the flow rate that is desired for that particular cylinder, meaning that the particular hydraulic cylinder is most likely being restricted from moving. When, the pressure of hydraulic system 48 is greater than about 90%, it can be concluded that at least one of hydraulic cylinders 20, 26 is pushing with extreme force against an obstacle, as is often the case during the stalled condition.

During the comparisons described above, when controller 58 determines that the ratio of actual-to-desired flow rates is greater than the first ratio threshold and that system pressure is low (i.e., less than the pressure threshold) (Step 330), controller 58 may conclude that a stall condition is not present in any of hydraulic cylinders 20, 26 (Step 340). In this situation, the desired flow rates may continue to be commanded to all valve elements of valve arrangements 54, 56 (Step 350). For example, in a particular application, the operator of machine 10 may manipulate interface device 98 to request maximum velocity of work tool 14 in both lifting and tilting, calling for a flow rate of 100 lpm (liters per minute) to be directed through each of valve arrangements 54, 56 to hydraulic cylinders 20, 26. In this situation, pump 52 may be capable of pressurizing a total of about 100 lpm. Accordingly, controller 58 may generate a commanded flow rate of 50 lpm directed to each of valve arrangements 54, 56. During completion of step 330, controller 58 may determine that hydraulic cylinders 20, 26 are moving at velocities that indicate the corresponding actual flow rates are nearly equal to the desired and commanded flow rates. Accordingly, controller 58 may calculate a ratio of actual-to-desired flow rates of about 1.0 for each of hydraulic cylinders 20, 26, which is much greater than the first ratio threshold associated with the stall condition. At about this same time, controller 58 may check system pressure and determine that the system pressure is only about 50% of a maximum pressure, also indicative of normal operation (i.e., operation during which no stall condition is occurring). Because no stall conditions have been detected, controller 58 may continue to direct a flow command of 50 lpm to each of valve arrangements 54, 56 as long as interface device 98 remains in the same maximum displaced position.

When controller 58 determines that the ratio for a particular subset of hydraulic cylinders 20, 26 is greater than the first ratio threshold, but system pressure is high (i.e., greater than the pressure threshold) (Step 360), controller 58 may determine that another of hydraulic cylinders 20, 26 not included in the subset is experiencing the stall condition (Step 370). In this situation, the desired flow rate plus an "add back" flow rate may be commanded of the respective valve arrangements 54, 56 associated with the non-stalled hydraulic cylinder(s) (Step 380). Continuing with the example described above, where the operator of machine 10 manipulated interface device 98 to request maximum velocity of work tool 14 in both lifting and tilting and controller 58 generated a commanded flow rate of 50 lpm directed to each of valve arrangements 54, 56, controller 58 may now determine that, although the ratio of actual-to-desired flow rate for hydraulic cylinder 26 is greater than the first ratio threshold (i.e., tilting is proceeding at a desired velocity), system pressure is higher than the pressure threshold. In this situation, controller 58 may determine that another actuator of machine 10 has been slowed dramatically or even completely stopped from moving by an external force (i.e., that hydraulic cylinders 20 have stalled, in the current example), thereby causing an abrupt rise in system pressure. Under these conditions, even though the flow rate command of 50 lpm is still being directed to each of valve arrangements 54, 56, only valve arrangement 56 may actually be passing fluid at or near the desired flow rate. Valve arrangement 54 may instead be passing very little fluid, if any. Accordingly, pump 52 may suddenly have an excess capacity (i.e., the add back flow rate) of about 50 lpm at this point in time that is not being consumed by any of hydraulic cylinders 20, 26. In order to improve productivity and efficiency of machine 10, that excess capacity may be directed to the non-stalled actuator(s) (i.e., to hydraulic cylinder 26, in the current example). Accordingly, the desired flow rate of fluid commanded of but not consumed by the stalled one of hydraulic cylinders 20, 26 may be added back to the flow rate command directed to the valve arrangement of the non-stalled ones of hydraulic cylinders 20, 26. That is, because of the rate of flow through valve arrangement 54, 100 lpm may now be commanded of valve arrangement 56.

In some applications, the add-back flow rate may be added back to the desired flow rate in a limited manner so as to inhibit jerky movements of machine 10. That is, if the flow rate command directed to valve arrangement 56 suddenly jumped from 50 lpm to 100 lpm, the tilting movement of machine 10 could suddenly double in velocity, which may be undesirable in some situations. Accordingly, controller 58 may be configured to increase the flow rate command by the add-back amount in a gradual manner. That is, controller 58 may limit the rate at which the flow rate command is increased. In one embodiment, the rate at which the flow rate command is increased may be limited to about 100-1500 lpm/sec, depending on the application.

When controller 58 determines that the ratio for a particular one of hydraulic cylinders 20, 26 is less than the first ratio threshold and system pressure is high (Step 390), controller 58 may determine that the particular one of hydraulic cylinders 20, 26 is experiencing the stall condition itself (Step 400), and the flow rate commanded of the respective valve arrangement 54, 56 associated with the stalled hydraulic cylinder 20, 26 may be limited to the lower of the desired flow rate or a default constant flow rate (Step 410). The default constant flow rate, in one example, may be about 10-50% of a maximum flow rate, and intended to inhibit abrupt work tool movement in the situation where the stall condition is suddenly relieved (i.e., where previously restricted machine movement is suddenly no longer restricted). Continuing with the example described above, where hydraulic cylinders 20 are determined to have stalled during lifting of work tool 14, the flow rate command subsequently directed to valve arrangement 54 may be reduced to about 5-25 lpm.

In some applications, an additional parameter may factor into the determination of whether a particular one of hydraulic cylinders 20, 26 is experiencing the stall condition. In particular, the disclosed embodiment may require that at least a minimum desired flow rate for a particular one of hydraulic cylinders 20, 26 be present, in order for the stall condition to exist. In one example, the minimum desired flow rate may be about 1-10% of the maximum flow rate. In situations where less than the minimum desired flow rate has been requested/commanded, limitations of velocity sensors 102, 103 may make comparison of the desired to actual flow difficult.

Controller 58 may be configured to maintain the stalled condition status for a particular one of hydraulic cylinders 20, 26 even after system pressure starts to decrease and/or the ratio of actual-to-desired flow rates begins to increase. That is, in order to improve machine stability in near-stall conditions, controller 58 may maintain the stalled condition status for a particular one of hydraulic cylinders 20, 26 until the ratio of actual-to-desired flow rates increases above a second ratio threshold greater than the first ratio threshold. In one example, the second ratio threshold may be about 0.3.

The disclosed control strategy and hardware of hydraulic control system 48 may help to improve the productivity and efficiency of machine 10. Specifically, during a mixed movement operation of machine 10 (e.g., during a combined lifting and tilting movement), excess flow intended for a stalled hydraulic cylinder may be diverted to a non-stalled cylinder. Because this excess capacity of pump 52 may be made available to the non-stalled hydraulic cylinders rather than destroking pump 52 to reduce its output, the productivity and efficiency of machine 10 may be improved.

In addition, because pump 52 may no longer be required to destroke and reduce its output as often or to as great an extent, modulation over the non-stalled hydraulic cylinders may be improved. In particular, as the pressure of the fluid discharged by pump 52 increases due to a stalled hydraulic cylinder, the discharge rate of pump 52 may be increasingly reduced. This reduction in flow rate might normally reduce flow to all hydraulic actuators, including the non-stalled hydraulic actuators. However, by redirecting the add-back flow to the non-stalled actuators, system pressure may be reduced without having to destroke pump 52. Accordingly, the output of pump 52 may remain substantially constant before and during stall conditions, thereby providing sufficient flow that allows full modulation of non-stalled hydraulic cylinders.

Finally, because the flow rate of fluid commanded to a stalled hydraulic actuator may be reduced, controllability over machine 10 may be enhanced when the actuator is again free to move. That is, upon being released from restriction, the once-stalled hydraulic actuator may slowly regain its full velocity, thereby reducing the likelihood of jerky machine movements.

It will be apparent to those skilled in the art that various modifications and variations can be made to the disclosed hydraulic control system. Other embodiments will be apparent to those skilled in the art from consideration of the specification and practice of the disclosed hydraulic control system. It is intended that the specification and examples be considered as exemplary only, with a true scope being indicated by the following claims and their equivalents.

What is claimed is:

1. A hydraulic control system, comprising:
- a hydraulic circuit;
- a pump configured to supply pressurized fluid to the hydraulic circuit;
- a first sensor associated with the hydraulic circuit and configured to generate a first signal indicative of a pressure of the hydraulic circuit;
- a first fluid actuator connected to receive pressurized fluid from the hydraulic circuit;
- a second sensor associated with the first fluid actuator and configured to generate a second signal indicative of a velocity of the first fluid actuator; and
- a controller in communication with the first and second sensors, the controller being configured to:
  - receive an input indicative of a desired flow rate for the first fluid actuator;
  - determine an actual flow rate of the first fluid actuator based on the second signal; and
  - determine a stall condition of the first fluid actuator based on the desired flow rate, the actual flow rate, and the first signal.

2. The hydraulic control system of claim 1, wherein the actual flow rate is determined as a function of the second signal and a flow area of the first fluid actuator.

3. The hydraulic control system of claim 2, wherein:
- the controller is further configured to determine a ratio of the actual flow rate for the first fluid actuator to the desired flow rate; and
- the stall condition of the first fluid actuator is determined based on the ratio and the first signal.

4. The hydraulic control system of claim 3, wherein the controller is configured to determine that the first fluid actuator is experiencing the stall condition only when the desired flow rate of the first fluid actuator is at or above a minimum amount.

5. The hydraulic control system of claim 4, wherein the minimum amount is about 1-10% of a maximum flow rate.

6. The hydraulic control system of claim 3, further including at least one other fluid actuator connected to receive pressurized fluid from the hydraulic circuit, wherein the controller is further configured to determine a stall condition of the at least one other fluid actuator based on the ratio of the actual flow rate of the first fluid actuator to the desired flow rate and on the first signal.

7. The hydraulic control system of claim 6, wherein the controller is configured to determine that the first fluid actuator is experiencing stall when the first signal indicates the pressure is greater than a pressure threshold and the ratio of actual flow rate to desired flow rate is less than a first ratio threshold.

8. The hydraulic control system of claim 7, wherein the pressure threshold is about 90% of a maximum system pressure.

9. The hydraulic control system of claim 8, wherein the first ratio threshold is less than about 0.2.

10. The hydraulic control system of claim 7, wherein the controller is configured to determine that the at least one other fluid actuator is experiencing the stall condition when the first signal indicates the pressure is greater than the pressure threshold and the ratio is greater than the first ratio threshold.

11. The hydraulic control system of claim 10, wherein the controller is configured to determine that no actuator fluidly connected to the hydraulic circuit is experiencing the stall condition when the first signal indicates the pressure is less than the pressure threshold.

12. The hydraulic control system of claim 7, wherein the controller is configured to maintain a stall condition status for the first fluid actuator until the ratio increases to a second ratio threshold greater than the first ratio threshold.

13. The hydraulic control system of claim 12, wherein the second ratio threshold is about 0.3.

14. The hydraulic control system of claim 1, further including an operator interface device displaceable through a range from a neutral position toward a maximum displacement position, wherein the input corresponds with a displacement position of the operator interface device within the range.

15. A method of operating a machine, comprising:
- pressurizing a fluid;
- sensing a pressure of the fluid;
- directing a first flow of the pressurized fluid to move the machine in a first manner;
- sensing an actual velocity of machine movement in the first manner;
- receiving an input indicative of a desired rate of the first flow;
- determining an actual rate of the first flow based on the actual velocity; and
- determining a stall condition associated with machine movement in the first manner based on the desired rate, the actual rate, and the pressure.

16. The method of claim 15, wherein:
- the method further includes determining a ratio of the actual rate to the desired rate; and
- the stall condition is determined based on the ratio and the pressure.

17. The method of claim 16, wherein determining the stall condition includes determining the stall condition only when the desired rate is at least about 1-10% of a maximum rate.

18. The method of claim 16, further including:
- directing a second flow of the pressurized fluid to move the machine in a second manner; and
- determining a stall condition associated with movement of the machine in the second manner based on the ratio of the actual rate of the first flow to the desired rate of the first flow and on the pressure.

19. The method of claim 18, wherein:

machine movement in the first manner is determined to be stalled when the pressure is greater than about 90% of a maximum pressure and the ratio is less than about 0.2;

machine movement in the second manner is determined to be stalled when the pressure is greater than about 90% of the maximum pressure and the ratio is greater than about 0.2; and no machine movements are determined to be stalled when the pressure is less than about 90% of the maximum pressure.

20. A machine, comprising:

a prime mover;

a body configured to support the prime mover;

a tool;

a linkage system operatively connecting the tool to the body;

a first hydraulic cylinder connected between the body and the linkage system to move the tool in a first manner;

a second hydraulic cylinder connected between the linkage system and the tool to move the tool in a second manner;

a pump driven by the prime mover to pressurize fluid directed to the first and second hydraulic cylinders;

a hydraulic circuit fluidly connecting the first and second hydraulic cylinders and the pump;

a first sensor associated with the hydraulic circuit and configured to generate a first signal indicative of a pressure of the hydraulic circuit;

a second sensor associated with the first hydraulic cylinder and configured to generate a second signal indicative of a velocity of the first hydraulic cylinder; and a controller in communication with the first and second sensors, the controller configured to:

receive an operator input indicative of a desired flow rate for the first hydraulic cylinder;

determine an actual flow rate of the first hydraulic cylinder based on the second signal and a flow area of the first hydraulic cylinder;

determine a ratio of the actual flow rate for the first hydraulic cylinder to the desired flow rate;

determine that the first hydraulic cylinder is experiencing stall when the first signal indicates the pressure is greater than about 90% of a maximum pressure, the ratio is less than about 0.2, and the desired flow rate is at least about 1-10% of a maximum flow rate;

determine that the second hydraulic cylinder is experiencing stall when the pressure is greater than about 90% of the maximum pressure and the ratio is greater than about 0.2; and determine that neither of the first and second hydraulic cylinders is experiencing stall when the pressure is less than about 90% of the maximum pressure.

* * * * *